US012534772B2

(12) United States Patent
Nakada et al.

(10) Patent No.: US 12,534,772 B2
(45) Date of Patent: Jan. 27, 2026

(54) HOT ROLLED STEEL SHEET AND METHOD FOR PRODUCING SAME

(71) Applicant: NIPPON STEEL CORPORATION, Tokyo (JP)

(72) Inventors: Kohei Nakada, Tokyo (JP); Takeshi Toyoda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 654 days.

(21) Appl. No.: 17/296,496

(22) PCT Filed: Mar. 2, 2020

(86) PCT No.: PCT/JP2020/008710
§ 371 (c)(1),
(2) Date: May 24, 2021

(87) PCT Pub. No.: WO2020/179737
PCT Pub. Date: Sep. 10, 2020

(65) Prior Publication Data

US 2022/0033927 A1 Feb. 3, 2022

(30) Foreign Application Priority Data

Mar. 6, 2019 (JP) ..... 2019-040948

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/40*** | (2006.01) |

(52) U.S. Cl.
CPC ..... *C21D 9/46* (2013.01); *C21D 8/0226* (2013.01); *C21D 8/0263* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/40* (2013.01); *C21D 2211/009* (2013.01)

(58) Field of Classification Search
CPC ..... C21D 8/0226; C21D 2211/009; C22C 38/02; C22C 38/04; B21C 47/02
See application file for complete search history.

(56) References Cited

U.S. PATENT DOCUMENTS

| | | | | |
|---|---|---|---|---|
| 10,253,397 | B2 | 4/2019 | Kimura et al. | |
| 11,680,305 | B2 | 6/2023 | Lee et al. | |
| 2005/0199322 | A1 | 9/2005 | Nakamura et al. | |
| 2013/0180631 | A1 | 7/2013 | Park et al. | |
| 2014/0000767 | A1* | 1/2014 | Yamasaki | C22C 38/001 148/333 |
| 2015/0107725 | A1 | 4/2015 | Im et al. | |
| 2015/0368768 | A1* | 12/2015 | Aratani | C22C 38/001 420/104 |
| 2016/0131222 | A1* | 5/2016 | Tagashira | C21D 8/0236 148/603 |
| 2017/0191149 | A1* | 7/2017 | Kimura | C22C 38/28 |
| 2018/0127858 | A1* | 5/2018 | Chassagne | C22C 38/06 |
| 2019/0316235 | A1 | 10/2019 | Lee et al. | |
| 2019/0338402 | A1 | 11/2019 | Kimura et al. | |

FOREIGN PATENT DOCUMENTS

| | | | | |
|---|---|---|---|---|
| CN | 102712963 | A | 10/2012 | |
| CN | 104220618 | A | 12/2014 | |
| CN | 110088336 | A | 8/2019 | |
| EP | 1 191 115 | A1 | 3/2002 | |
| EP | 3228721 | A1 * | 10/2017 | C21D 8/06 |
| JP | 2001-164322 | A | 6/2001 | |
| JP | 2011-12316 | A | 1/2011 | |
| JP | 2011-99129 | A | 5/2011 | |
| JP | 2011-99132 | A | 5/2011 | |
| JP | 2011-530659 | A | 12/2011 | |
| JP | 5050386 | B2 * | 10/2012 | |
| JP | 2015-515548 | A | 5/2015 | |
| JP | 2016-98414 | A | 5/2016 | |
| KR | 2003-0016434 | A | 3/2003 | |
| KR | 10-2006-0043099 | A | 5/2006 | |
| KR | 10-2012-0029347 | A | 3/2012 | |
| KR | 10-2013-0068402 | A | 6/2013 | |
| WO | WO 2011/089845 | A1 | 7/2011 | |

* cited by examiner

*Primary Examiner* — Jonathan Johnson

(74) *Attorney, Agent, or Firm* — Birch, Stewart, Kolasch & Birch, LLP

(57) ABSTRACT

Provided is a hot rolled steel sheet comprising a predetermined chemical composition, and a metallic structure comprising, by area ratio, pearlite: 90 to 100%, pseudo pearlite: 0 to 10%, and pro-eutectoid ferrite: 0 to 1%, wherein the pearlite has an average lamellar spacing of 0.20 μm or less, and the pearlite has an average pearlite block size of 20.0 μm or less. Provided is a method for producing a hot rolled steel sheet comprising heating a slab to 1100° C. or more, hot rolling where an exit side temperature of finishing rolling is 820 to 920° C., primary cooling the steel sheet down to an Ae1 point by an average cooling rate of 40 to 80° C./s, then secondary cooling the steel sheet from the Ae1 point down to a coiling temperature by an average cooling rate of less than 20° C./s, and coiling the steel sheet at a coiling temperature of 540 to 700° C.

16 Claims, 1 Drawing Sheet

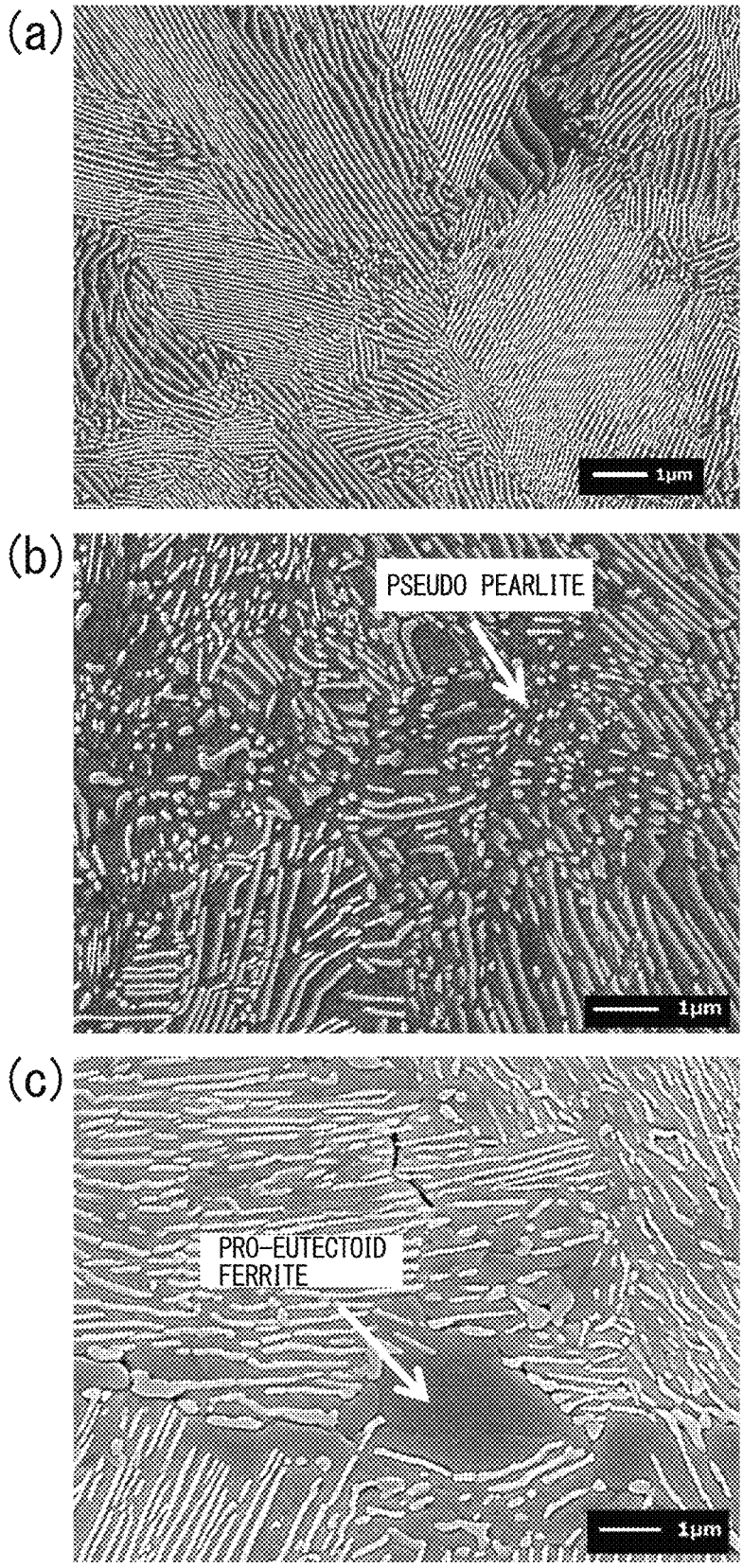
(a)
1μm
(b)
PSEUDO PEARLITE
1μm
(c)
PRO-EUTECTOID
FERRITE
1μm

HOT ROLLED STEEL SHEET AND METHOD FOR PRODUCING SAME

FIELD

The present invention relates to hot rolled steel sheet and a method for producing the same, more particularly relates to hot rolled steel sheet which is used for a structural member of an automobile etc., which is high in strength with a tensile strength of 980 MPa or more, and which is excellent in ductility, hole expandability, and stampability and to a method for producing the same.

BACKGROUND

In recent years, in the automobile industry, reduction of the weight of car bodies has been sought from the viewpoint of improvement of fuel efficiency. On the other hand, due to tougher regulations regarding collision safety, addition of reinforcement parts in car body frames etc., have become necessary and have led to an increase of weight. In order to achieve both lighter weight of car bodies and collision safety, increasing the strength of the steel sheet used is one effective method. Due to such a background, efforts are underway to develop a high strength steel sheet.

However, there is the problem that as steel sheet is made higher in strength, generally the shapeability of the steel sheet falls and, for example, the ductility and hole expandability (indicator showing stretch flangeability of steel sheet) and other mechanical properties fall. Therefore, in the development of a high strength steel sheet, achieving higher strength without causing these mechanical properties to fall has become an important issue.

PTL 1 describes a high strength high ductility steel sheet comprising a composition of constituents containing, by mass %, C: 0.4 to 0.8%, Si: 0.8 to 3.0%, and Mn: 0.1 to 0.6% and a balance of iron and unavoidable impurities, and a steel microstructure including, by area ratio with respect to the entire microstructure, pearlite in 80% or more and residual austenite in 5% or more, an average lamellar spacing of the pearlite of 0.5 μm or less, an effective crystal grain size of ferrite surrounded by large angle grain boundaries of orientation differences of 15° or more of 20 μm or less, and carbides having a circle equivalent diameter of 0.1 μm or more of 5 or less per 400 $\mu m^2$. Further, PTL 1 describes that according to the above high strength high ductility steel sheet, it is possible to make pearlite the main structures while reducing its lamellar spacing to raise the yield strength (YS) and to make the effective ferrite grains finer to raise the stretch flangeability (X) and, furthermore, to make the residual austenite disperse to raise the elongation (EL) and thereby secure a tensile strength (TS) of 980 MPa or more, a yield ratio YR (=YS/TS) of 0.8 or more, a tensile strength (TS)×elongation (EL) of 14000 MPa·% or more, and a stretch flangeability (X) of 35% or more.

PTL 2 describes a high carbon hot rolled steel sheet consisting of, by mass %, C: 0.60 to 1.20%, Si: 0.10 to 0.35%, Mn: 0.10 to 0.80%, P: greater than 0 and 0.03% or less, and S: greater than 0 and 0.03% or less, one or more of Ni: 0.25% or less (including 0), Cr: 0.30% or less (including 0), and Cu: 0.25% or less (including 0) and a balance of Fe and other unavoidable impurities, and containing micro pearlite structures having a width of cementite greater than 0 and 0.2 μm or less and a spacing between the cementite and cementite greater than 0 and 0.5 μm or less. Further, PTL 2 describes that since the high carbon hot rolled steel sheet has micro pearlite structures, the final finished product can be given durability and strength.

PTL 3 describes a high strength steel sheet comprising a composition of constituents consisting of, by mass %, C: 0.3 to 0.85%, Si: 0.01 to 0.5%, Mn: 0.1 to 1.5%, P: 0.035% or less, S: 0.02% or less, Al: 0.08% or less, N: 0.01% or less, Cr: 2.0 to 4.0% and a balance of Fe and unavoidable impurities, and a microstructure containing rolled pearlite structures, wherein a ratio of amount of dissolved C calculated by a predetermined formula is 50% or more. Further, PTL 3 describes that according to the above high strength steel sheet, excellent bendability and higher strength of a tensile strength of 1500 MPa or more can be realized.

PTL 4 describes a method for producing thin-gauge steel sheet comprising roughing rolling a continuously cast slab having a C content of 0.8 mass % or less to prepare a rough bar, finishing rolling the rough bar by a finish temperature of ($Ar_3$ transformation point −20) ° C. or more to prepare a steel strip, primary cooling the steel strip after finishing rolling down to 500 to 800° C. in temperature by a cooling rate of more than 120° C./sec, allowing the steel strip after the primary cooling to cool for 1 to 30 seconds, secondary cooling the steel strip after cooling by a cooling rate of 20° C./sec or more, and coiling the steel strip after the secondary cooling by a coiling temperature of 650° C. or less. Further, PTL 4 describes that according to the above producing method, thin-gauge steel sheet excellent in workability, including stretch flangeability, and having uniform mechanical properties of various strength levels is obtained.

PTL 5 describes a soft high carbon steel sheet comprising, by mass %, C: 0.70 to 0.95%, Si: 0.05 to 0.4%, Mn: 0.5 to 2.0%, P: 0.005 to 0.03%, S: 0.0001 to 0.006%, Al: 0.005 to 0.10%, N: 0.001 to 0.01%, and a balance of Fe and unavoidable impurities, and a microstructure having 100 or more voids per 1 $mm^2$ of the observed microstructure. Further, PTL 5 describes that by having the above constitution, it is possible to provide a soft high carbon steel sheet excellent in stampability. In addition, in order to obtain the above soft high carbon steel sheet, PTL 5 teaches a production method comprising cooling, coiling, and pickling a hot rolled steel sheet under predetermined conditions, then performing softening box annealing.

CITATIONS LIST

Patent Literature

[PTL 1] Japanese Unexamined Patent Publication No. 2016-098414

[PTL 2] Japanese Unexamined Patent Publication No. 2011-530659

[PTL 3] Japanese Unexamined Patent Publication No. 2011-099132

[PTL 4] Japanese Unexamined Patent Publication No. 2001-164322

[PTL 5] Japanese Unexamined Patent Publication No. 2011-012316

SUMMARY

Technical Problem

In PTL 1, a steel material not containing Cr or containing Cr in a relatively small amount is hot rolled, then cold rolled, then subjected to predetermined heat treatment to thereby produce steel sheet. However, with such a composition of constituents and production method, the average lamellar spacing of the pearlite cannot necessarily be made sufficiently small. Accordingly, in the high strength high ductility steel sheet described in PTL 1, there was still room for improvement relating to improving the mechanical properties.

The high carbon hot rolled steel sheet described in PTL 2, in the same way as the case of the high strength high ductility steel sheet described in PTL 1, either does not contain Cr or contains Cr in only a relatively small amount. Further, PTL 2 describes that due to having micro pearlite structures, the final finished product can be given durability and strength, as explained above, but does not disclose the specific tensile strength. In addition, PTL 2 does not sufficiently study improvement of the other mechanical properties, for example, ductility and hole expandability etc.

PTL 3 discloses a high strength steel sheet having a tensile strength of 1500 MPa or more, but does not sufficiently study improvement of the hole expandability and other mechanical properties. In actuality, the high strength steel sheet described in PTL 3 is produced by preparing a billet having pearlite structures as its main phases by pearlite forming treatment in an annealing furnace, then cold rolling this by a rolling rate of 90% or more, but in the case of such a production method, due to the above cold rolling, a microstructure is formed with the directions of the layered cementite in the pearlite aligned with the rolling direction. However, since such a microstructure lowers the hole expandability, with the high strength steel sheet described in PTL 3, it is difficult to achieve a hole expandability suitable to use as a steel sheet for automobile.

Further, in working auto parts etc., often stamping processes using press machines are included, but in particular there is the problem that if stamping a high strength steel sheet, due to the increase in strength of steel sheet, cracks (stamping cracks) easily occur at the stamped end faces. On the other hand, PTLs 1 to 4 do not also sufficiently study improvement of the stampability of a high strength steel sheet.

In relation to this, PTL 5 describes that it is possible to provide a soft high carbon steel sheet excellent in stampability, as explained above. However, in PTL 5, softening box annealing is performed as the heat treatment for obtaining the soft high carbon steel sheet, and therefore the carbides become spherical and fine lamellar structures cannot be obtained. Therefore, with the soft high carbon steel sheet described in PTL 5, there was still room for improvement relating to improving the mechanical properties.

Therefore, the present invention has as its object to provide a hot rolled steel sheet which is high in strength with a tensile strength of 980 MPa or more and which is excellent in ductility, hole expandability, and stampability and a method for producing the same by a novel configuration.

Solution to Problem

The inventors studied the chemical composition and microstructure of a hot rolled steel sheet so as to achieve the above object. As a result, the inventors discovered that it is important to make the structure of the hot rolled steel sheet mainly pearlite, which has a good balance of strength and ductility, and in addition to suitably control the microstructure of the pearlite. More specifically, the inventors discovered that by including pearlite in the hot rolled steel sheet in an area ratio of 90% or more, it is possible to secure ductility, on the other hand, by not including residual austenite, it is possible to secure stampability, and, in addition, by making the pearlite blocks (corresponding to regions where ferrite forming the pearlite is aligned in crystal orientation) finer, it is possible to suppress the occurrence of cracking at the time of local deformation and secure hole expandability and, furthermore, by making the lamellar spacing of the pearlite finer while maintaining the pearlite fraction of 90% or more, it is possible to increase the strength of the hot rolled steel sheet without detracting from the ductility and hole expandability, and thereby completed the present invention. Since increase of the strength of the hot rolled steel sheet by making the lamellar spacing of pearlite finer is unrelated with improvement of the ductility and hole expandability, by controlling the structure in the above way, it is possible to obtain excellent ductility and hole expandability even with higher strength.

The present invention was completed based on the above findings. Specifically, it is as follows:

(1) A hot rolled steel sheet comprising a chemical composition comprising, by mass %,
C: 0.50 to 1.00%,
Si: 0.01 to 0.50%,
Mn: 0.50 to 2.00%,
P: 0.100% or less,
S: 0.0100% or less,
Al: 0.100% or less,
N: 0.0100% or less,
Cr: 0.50 to 2.00%,
Cu: 0 to 1.00%,
Ni: 0 to 1.00%,
Mo: 0 to 0.50%,
Nb: 0 to 0.10%,
V: 0 to 1.00%,
Ti: 0 to 1.00%,
B: 0 to 0.0100%,
Ca: 0 to 0.0050%,
REM: 0 to 0.0050%, and
balance: Fe and impurities, and
a metal structure comprising, by area ratio,
pearlite: 90 to 100%,
pseudo pearlite: 0 to 10%, and
pro-eutectoid ferrite: 0 to 1%, wherein
the pearlite has an average lamellar spacing of 0.20 μm or less, and
the pearlite has an average pearlite block size of 20.0 μm or less.

(2) The hot rolled steel sheet according to the above (1), wherein the chemical composition comprises, by mass %, one or more of
Cu: 0.01 to 1.00%,
Ni: 0.01 to 1.00%,
Mo: 0.01 to 0.50%,
Nb: 0.01 to 0.10%,
V: 0.01 to 1.00%, and
Ti: 0.01 to 1.00%.

(3) The hot rolled steel sheet according to the above (1) or (2), wherein the chemical composition comprises, by mass %, B: 0.0005 to 0.0100%.

(4) The hot rolled steel sheet according to any one of the above (1) to (3), wherein the chemical composition comprises, by mass %, one or both of
Ca: 0.0005 to 0.0050% and
REM: 0.0005 to 0.0050%.

(5) The hot rolled steel sheet according to any one of the above (1) to (4), wherein the hot rolled steel sheet has a tensile strength of 980 MPa or more.

(6) A method for producing a hot rolled steel sheet comprising heating a slab having the chemical composition of any one of the above (1) to (4) to 1100° C. or more, hot rolling including finishing rolling the heated slab, wherein an exit side temperature of the finishing rolling is 820 to 920° C., primary cooling the obtained steel sheet down to an Ae1 point by an average cooling rate of 40 to 80° C./s, then secondary cooling the steel sheet from the Ae1 point down to a coiling temperature by an average cooling rate of less than 20° C./s, and coiling the steel sheet at a coiling temperature of 540 to 700° C.

Advantageous Effects of Invention

According to the present invention, it is possible to obtain a hot rolled steel sheet which is high in strength with a tensile strength of 980 MPa or more and which is excellent in ductility, hole expandability, and stampability.

BRIEF DESCRIPTION OF DRAWINGS

FIG. 1 is a reference view showing pearlite, pseudo pearlite, and pro-eutectoid ferrite.

DESCRIPTION OF EMBODIMENTS

Hot Rolled Steel Sheet

The hot rolled steel sheet according to an embodiment of the present invention comprises a chemical composition comprising, by mass %, C: 0.50 to 1.00%,
Si: 0.01 to 0.50%,
Mn: 0.50 to 2.00%,
P: 0.100% or less,
S: 0.0100% or less,
Al: 0.100% or less,
N: 0.0100% or less,
Cr: 0.50 to 2.00%,
Cu: 0 to 1.00%,
Ni: 0 to 1.00%,
Mo: 0 to 0.50%,
Nb: 0 to 0.10%,
V: 0 to 1.00%,
Ti: 0 to 1.00%,
B: 0 to 0.0100%,
Ca: 0 to 0.0050%,
REM: 0 to 0.0050%, and
balance: Fe and impurities, and
a metal structure comprising, by area ratio,
pearlite: 90 to 100%,
pseudo pearlite: 0 to 10%, and
pro-eutectoid ferrite: 0 to 1%, wherein
the pearlite has an average lamellar spacing of 0.20 μm or less, and
the pearlite has an average pearlite block size of 20.0 μm or less.

First, the chemical composition of a hot rolled steel sheet according to an embodiment of the present invention and a slab used for its production will be explained. In the following explanation, the "%" of the units of contents of the elements contained in the hot rolled steel sheet and slab means "mass %" unless otherwise particularly indicated.

C: 0.50 to 1.00%

C is an element essential for securing the strength of the hot rolled steel sheet. To sufficiently obtain such an effect, the content of C is 0.50% or more. The content of C may also be 0.53% or more, 0.55% or more, 0.60% or more, or 0.65% or more. On the other hand, if excessively containing C, cementite precipitates and sometimes a sufficient pearlite fraction cannot be obtained or sometimes the ductility or weldability falls. For this reason, the content of C is 1.00% or less. The content of C may also be 0.95% or less, 0.90% or less, 0.85% or less, 0.80% or less, or 0.75% or less. Further, in the hot rolled steel sheet according to the embodiment of the present invention, the ratio, with respect to the total amount of C in the steel (content of C), of the amount of dissolved C (content of *C minus* amount of C precipitating as cementite) is generally less than 50%. More specifically, if performing strong working under a high rolling reduction in the cold rolling, the amount of dissolved C sometimes increases, but in the hot rolled steel sheet according to the embodiment of the present invention where such cold rolling is not performed, the ratio of the amount of dissolved C is generally considerably lower than 50%, for example, is 30% or less, 20% or less, or 10% or less.

Si: 0.01 to 0.50%

Si is an element used for deoxidizing steel. However, if the content of Si is excessive, the chemical convertability falls and austenite remains in the microstructure of the steel sheet, so the stampability of the steel sheet deteriorates. For this reason, the content of Si is 0.01 to 0.50%. The content of Si may also be 0.05% or more, 0.10% or more, or 0.15% or more and/or may be 0.45% or less, 0.40% or less, or 0.30% or less.

Mn: 0.50 to 2.00%

Mn is an element effective for delaying phase transformation of the steel and preventing phase transformation from occurring in the middle of cooling. However, if the content of Mn becomes excessive, microsegregation or macrosegregation easily occurs and the hole expandability is made to deteriorate. For this reason, the content of Mn is 0.50 to 2.00%. The content of Mn may be 0.60% or more, 0.70% or more, or 0.90% or more as well and/or may be 1.90% or less, 1.70% or less, 1.50% or less, or 1.30% or less.

P: 0.100% or Less

The lower the content of P, the better, but if excessive, it has a detrimental effect on the shapeability and weldability and causes a drop in the fatigue properties as well, so the content is 0.100% or less. Preferably, it is 0.050% or less, more preferably 0.040% or less, or 0.030% or less. The content of P may be 0% as well, but excessive reduction invites a rise in costs, so the content is preferably 0.0001% or more.

S: 0.0100% or Less

S forms MnS which acts as the starting points for fracture and causes a remarkable drop in the hole expandability of steel sheet. For this reason, the content of S is 0.0100% or less. The content of S is preferably 0.0090% or less, more preferably is 0.0060% or less or 0.0010% or less. The content of S may be 0% as well, but excessive reduction invites a rise in costs, so the content is preferably 0.0001% or more.

Al: 0.100% or Less

Al is an element used for deoxidizing steel. However, if the content of Al is excessive, inclusions increase and cause the workability of the steel sheet to deteriorate. For this reason, the content of Al is 0.100% or less. The content of Al may be 0% as well, but the content is preferably 0.005% or more or 0.010% or more. On the other hand, the content of Al may be 0.080% or less, 0.050% or less, or 0.040% or less.

N: 0.0100% or Less

N bonds with the Al in the steel to form AlN which obstructs the increase in pearlite block size due to a pinning effect. However, if the content of N becomes excessive, that effect becomes saturated and rather a drop in toughness is caused. For this reason, the content of N is 0.0100% or less. The content of N is preferably 0.0090% or less, 0.0080% or less, or 0.0050% or less. From this viewpoint, there is no need to set a lower limit of the content of N. The content may be 0% as well. However, to reduce the content of N to less than 0.0010%, the steelmaking costs will swell. For this reason, the content of N is preferably 0.0010% or more.

Cr: 0.50 to 2.00%

Cr has the effect of making the lamellar spacing of the pearlite finer and thereby can secure the strength of the steel sheet. To sufficiently obtain such an effect, the lower limit of the content of Cr is 0.50%, preferably 0.60%. On the other hand, excessively adding Cr results in structures such as pseudo pearlite and bainite easily appearing and makes it difficult to obtain a pearlite fraction of 90% or more. For this reason, the upper limit of the content of Cr is 2.00%, 1.50%, 1.25%, preferably 1.15%.

The basic composition of constituents of the hot rolled steel sheet according to an embodiment of the present invention and the slab used for its production is as explained above. Furthermore, the hot rolled steel sheet and slab may if necessary contain any of the following optional elements. Inclusion of these elements is not essential. The lower limits of the contents of these elements are 0%.

Cu: 0 to 1.00%

Cu is an element able to dissolve in the steel and improve the strength without detracting from the toughness. The content of Cu may be 0%, but Cu may be included as required to obtain the above effect. However, if the content is excessive, due to the increase in precipitates, at the time of hot working, microcracks are sometimes formed at the surface. Therefore, the content of Cu is preferably 1.00% or less or 0.60% or less, more preferably 0.40% or less or 0.25% or less. To sufficiently obtain such an effect, the content of Cu is preferably 0.01% or more, more preferably 0.05% or more.

Ni: 0 to 1.00%

Ni is an element which can dissolve in the steel to raise the strength without detracting from the toughness. The content of Ni may be 0% as well, but Ni may be included as needed to obtain that effect. However, Ni is an expensive element. Excessive addition invites a rise in costs. Therefore, the content of Ni is preferably 1.00% or less or 0.80% or less, more preferably 0.60% or less or 0.30% or less. To sufficiently obtain that effect, the content of Ni is preferably 0.10% or more, more preferably 0.20% or more.

Mo: 0 to 0.50%

Mo is an element increasing the strength of steel. The content of Mo may be 0% as well, but Mo may be included as needed to obtain that effect. However, if the content is excessive, the drop in toughness accompanying an increase in strength becomes remarkable. Therefore, the content of Mo is preferably 0.50% or less or 0.40% or less, more preferably 0.20% or less or 0.10% or less. To sufficiently obtain that effect, the content of Mo is preferably 0.01% or more, more preferably 0.05% or more.

Nb: 0 to 0.10%

V: 0 to 1.00%

Ti: 0 to 1.00%

Nb, V, and Ti contribute to improvement of the steel sheet strength by the precipitation of carbides, so one selected from these may be included alone in accordance with need or two or more may be included compositely. However, if any of these elements is included in excess, a large amount of carbides are formed and the toughness of the steel sheet is lowered. For this reason, the content of Nb is preferably 0.10% or less or 0.08% or less, more preferably 0.05% or less, the content of V is preferably 1.00% or less or 0.80% or less, more preferably 0.50% or less or 0.20% or less, and the content of Ti is preferably 1.00% or less or 0.50% or less, more preferably 0.20% or less or 0.04% or less. On the other hand, the lower limit values of the contents of Nb, V, and Ti may be, for all of the elements, 0.01% or 0.03%.

B: 0 to 0.0100%

B has the effect of segregating at the grain boundaries and raising the intergranular strength, so may be included in accordance with need. However, if the content is excessive, the effect becomes saturated and the costs of the raw materials swell. For this reason, the content of B is 0.0100% or less. The content of B is preferably 0.0080% or less, 0.0060% or less, or 0.0020% or less. To sufficiently obtain the above effect, the content of B is preferably 0.0005% or more, more preferably 0.0010% or more.

Ca: 0 to 0.0050%

Ca is an element which controls the form of the nonmetallic inclusions which act as the starting points of fracture and cause deterioration of workability and which improves the workability, so may be included in accordance with need. However, if the content is excessive, the effect becomes saturated and the costs of the raw materials swell. For this reason, the content of Ca is 0.0050% or less. The content of Ca is preferably 0.0040% or less or 0.0030% or less. To sufficiently obtain the above effect, the content of Ca is preferably 0.0005% or more.

REM: 0 to 0.0050%

REM is an element improving the toughness of the weld zone by addition in fine amounts. The content of the REM may also be 0%, but these may be included in accordance with need to obtain the above effect. However, if excessively added, conversely the weldability deteriorates. For this reason, the content of the REM is preferably 0.0050% or less or 0.0040% or less. To sufficiently obtain the above effect, the content of REM is preferably 0.0005% or more, more preferably 0.0010% or more. Note that, "REM" is the general term for a total 17 elements of Sc, Y, and the lanthanoids. The content of REM means the total amount of the above elements.

In the hot rolled steel sheet according to an embodiment of the present invention, the balance aside from the constituents explained above is comprised of Fe and impurities. Impurities are constituents etc., entering due to various factors in the producing process such as the ore, scrap, and other such raw materials when industrially producing hot rolled steel sheet.

Next, the reasons for limitation of the structure of the hot rolled steel sheet according to an embodiment of the present invention will be explained.

Pearlite: 90 to 100%

By making the metallic structure of the steel sheet a structure mainly comprised of pearlite, it is possible to obtain a steel sheet maintaining a high strength while being excellent in ductility and hole expandability. If the pearlite is present in an area ratio of less than 90%, the ductility cannot be secured and/or the hole expandability cannot be secured due to the unevenness of the structure. For this reason, the content of pearlite in the metallic structure of the hot rolled steel sheet according to an embodiment of the present invention is an area ratio of 90% or more, preferably 95% or more, 96% or more, 97% or more, 98% or more, or 99% or more. It may also be 100%.

Pseudo Pearlite: 0 to 10%

Pro-Eutectoid Ferrite: 0 to 1%

The remaining structure other than the pearlite may be 0%, but if this is a remaining structure present, it is comprised of at least one of pseudo pearlite and pro-eutectoid ferrite. By configuring the remaining structure from at least one of pseudo pearlite and pro-eutectoid ferrite, that is, by not including residual austenite in the remaining structure, good stampability can be secured. In the present invention, "pseudo pearlite" means, as opposed to pearlite in which the ferrite phases and cementite are dispersed in a layered state (lamellar state), structures mainly comprised of cementite dispersed in clumps, more specifically structures containing such clump shaped cementite in an area ratio of more than 50% with respect to the total amount of cementite in the structures, and may contain some lamellar cementite. Further, in the present invention, "pro-eutectoid ferrite" means ferrite precipitating as primary crystals in the cooling stage after hot rolling and substantially not containing cementite, that is, having a fraction of cementite in the crystal grains of an area ratio of less than 1% (for example, see reference view of FIG. 1(*c*)). Note that, the pseudo pearlite may be present in an area ratio of 0 to 10%, for example, an area ratio of 8% or less, 6% or less, 4% or less, 3% or less, 2% or less, or 1% or less. Pro-eutectoid ferrite may be present in an area ratio of 0 to 1%, for example, an area ratio of 0.8% or less or 0.6% or less. In a hot rolled steel sheet according to an embodiment of the present invention, either residual austenite, pro-eutectoid cementite, bainite, and martensite are not present in the metallic structure or are substantially not present. "Substantially not present" means the area ratios of these structures are, even in total, less than 0.5%. It is difficult to accurately measure the total amount of such fine structures. Further, their effects can be ignored. Therefore, when the total amount of these structures becomes less than 0.5%, it can be judged that they are not present.

Average lamellar spacing of pearlite: 0.20 μm or less

The average lamellar spacing of the pearlite (however, excluding the above-mentioned pseudo pearlite) is strongly correlated with the strength of steel sheet. The smaller the average lamellar spacing, the higher the strength that is obtained. Furthermore, if the same constituents, the smaller the average lamellar spacing, the better the hole expandability of the steel sheet. With an average lamellar spacing of more than 0.20 μm, a tensile strength of 980 MPa or more is not obtained and/or the hole expandability falls, so the average lamellar spacing of pearlite in the metallic structure in hot rolled steel sheet according to an embodiment of the present invention is 0.20 μm or less, preferably 0.15 μm or less, or 0.10 μm or less. Note that, the lower limit value of the average lamellar spacing of pearlite is not particularly limited, but for example may be 0.05 μm or 0.07 μm.

Average Pearlite Block Size of Pearlite: 20.0 μm or Less

A "pearlite block" corresponds to a region where the ferrite forming the pearlite (however, except above-mentioned pseudo pearlite) is aligned in crystal orientation. Here, the average pearlite block size of pearlite is correlated with the local ductility and toughness of steel sheet. The smaller the average pearlite block size, the more the hole expandability is improved. With an average pearlite block size of more than 20.0 μm, the hole expandability ends up deteriorating, so the average pearlite block size of the metallic structure of the hot rolled steel sheet according to an embodiment of the present invention is 20.0 μm or less, preferably 18.0 μm or less, more preferably 16.0 μm or less. Note that, the lower limit value of the average pearlite block size of pearlite is not particularly limited, but for example may be 3.0 μm, 5.0 μm, or 7.0 μm.

Method of Judgment and Method of Measurement of Pearlite and Remaining Structure The fractions of the pearlite and remaining structure are found in the following way. First, samples are taken from positions of ¼ or ¾ of the thickness from the surface of the steel sheet so that the cross-sections parallel to the rolling direction and the thickness direction of the steel sheet become the observed surfaces. Next, the observed surfaces are polished to a mirror finish, corroded by a picral etchant, then examined for structure using a scanning electron microscope (SEM). The magnification is 5000× (measurement region: 80 μm×150 μm). From the obtained structural photograph, using the point calculation method, regions where the cementite forms layers are judged to be pearlite (for example, see reference view of FIG. 1(*a*)) and the fraction of the same is calculated. On the other hand, structures where the ferrite phases and cementite are not dispersed in layers, but are mainly comprised of cementite dispersed in clumps are judged to be pseudo pearlite (for example, see reference figure of FIG. 1(*b*)) and the fraction of the same is calculated. Further, assemblies of lath shaped crystal grains which have pluralities of iron-based carbides with major axes of 20 nm or more inside the laths and furthermore have these carbides belonging to groups of iron-based carbides of single variants, that is, stretched in the same directions, are judged to be bainite. Further, regions of clump like or film like iron-based carbides with circle equivalent diameters of 300 nm or more are judged to be pro-eutectoid cementite. In the case of structures such as in FIG. 1(*a*) or (*b*), the observed inclusions are basically cementite. There is no need to use a scanning electron microscope (SEM-EDS) equipped with an energy dispersive type X-ray spectroscope etc., to identify individual inclusions as cementite or iron-based carbides. It is possible to use SEM-EDS etc., to analyze inclusions, separate from examination by SEM, as required only when a doubt arises as to their being cementite or iron-based carbides. Pro-eutectoid ferrite and residual austenite both have less than 1% area fractions of cementite inside them. If such structures, after examination of the structures by SEM, electron back scatter diffraction (EBSD) is used for analysis and bcc structures are judged as pro-eutectoid ferrite and fcc structures are judged as residual austenite.

Method of Measurement of Average Lamellar Spacing

The average lamellar spacing is found as follows: First, samples are taken from positions of ¼ or ¾ of the thickness from the surface of the steel sheet so that the cross-sections parallel to the rolling direction and the thickness direction of the steel sheet become the observed surfaces. Next, the observed surfaces are polished to a mirror finish, corroded by a picral etchant, then examined for structure using a scanning electron microscope (SEM). The magnification is 5000× (measurement region: 80 μm×150 μm). 10 or more locations where the cementite layer vertically traverses the paper surface of the structural photograph are selected. Information on the depth direction is obtained by measurement by corrosion by a picral etchant, so the locations vertically traversing the cementite layer are known. By measurement selecting 10 or more such locations, the lamellar spacings S are found at the respective locations. The average of these is taken to obtain the average lamellar spacing. The method of measurement of the lamellar spacing at the individual locations is as follows: First, a line is drawn vertical to the cementite layers so as to cut across 10 to 30 cementite layers. The lengths of the lines are made "L". The number of cementite layers which that line crosses is defined as "N". At this time, the lamellar spacing S at that location is found by S=L/N.

Method of Measurement of Average Pearlite Block Size

The average pearlite block size is measured using EBSD. First, samples are taken from positions of ¼ or ¾ of the thickness from the surface of the steel sheet so that the cross-sections parallel to the rolling direction and the thickness direction of the steel sheet become the observed surfaces. Next, the observed surfaces are polished to a mirror finish, EBSD is used to measure the crystal orientation of iron, and the crystal grain boundaries are found. A crystal grain boundary is defined as a boundary where the crystal orientation changes by 15°. The measurement region is 100 μm×200 μm and the distance between measurement points is 0.2 μm in pitch. Finally, the circle equivalent diameter is found from the area of the region surrounded by the crystal grain boundaries. The average value of the circle equivalent diameters calculated for all of the crystal grains in the measurement region by the area fraction method is defined as the average pearlite block size.

Mechanical Properties

According to the hot rolled steel sheet having the above chemical composition and structure, high tensile strength, specifically a 980 MPa or more tensile strength, can be achieved. The tensile strength is 980 MPa or more so as to satisfy the demand for lighter weight of car bodies in automobiles. The tensile strength is preferably 1050 MPa or more, more preferably 1100 MPa or more. The upper limit value does not have to be particularly prescribed, but, for example, the tensile strength may be 1500 MPa or less, 1400 MPa or less, or 1300 MPa or less. Similarly, according to the hot rolled steel sheet having the above chemical composition and structure, a high ductility can be realized, more specifically a 13% or more, preferably 15% or more, more preferably 17% or more total elongation can be realized. The upper limit value does not have to be particularly prescribed, but, for example, the total elongation may be 30% or less or 25% or less. Furthermore, according to the hot rolled steel sheet having the above chemical composition and structure, excellent hole expandability can be realized, more specifically, a 45% or more, preferably 50% or more, more preferably 55% or more hole expandability can be realized. The upper limit value does not have to be particularly prescribed, but, for example, the hole expandability may be 80% or less or 70% or less. The tensile strength and total elongation are measured by taking a JIS No. 5 tensile test piece from a direction perpendicular to the rolling direction of the hot rolled steel sheet and subjecting it to a tensile test based on JIS Z2241(2011). On the other hand, the hole expandability is measured by conducting a hole expansion test based on JIS Z2256 (2010).

Thickness

The hot rolled steel sheet according to an embodiment of the present invention generally has a thickness of 1.0 to 6.0 mm. While not particularly limited, the thickness may be 1.2 mm or more or 2.0 mm or more and/or may be 5.0 mm or less or 4.0 mm or less.

Method for Producing Hot Rolled Steel Sheet

The method for producing a hot rolled steel sheet according to an embodiment of the present invention comprises

- heating a slab having a chemical composition explained above to 1100° C. or more,
- hot rolling including finishing rolling the heated slab, wherein an exit side temperature of the finishing rolling is 820 to 920° C.,
- primary cooling the obtained steel sheet down to an Ae1 point by an average cooling rate of 40 to 80° C./s, then secondary cooling the steel sheet from the Ae1 point down to a coiling temperature by an average cooling rate of less than 20° C./s, and
- coiling the steel sheet at a coiling temperature of 540 to 700° C. Below, each step will be explained in detail.

Heating of Slab

First, a slab having the chemical composition explained above is heated before hot rolling. The heating temperature of the slab is 1100° C. or more so as to make the Ti carbonitrides etc., sufficiently redissolve. The upper limit value is not particularly prescribed, but for example may be 1250° C. Further, the heating time is not particularly limited, but for example may be 30 minutes or more and/or may be 120 minutes or less. Note that, the slab used is preferably cast by the continuous casting method from the viewpoint of productivity, but may also be produced by the ingot casting method or thin slab casting method.

Hot Rolling

Roughing Rolling

In the present method, for example, the heated slab may be roughing rolled before the finishing rolling so as to adjust the thickness etc. The roughing rolling is not particularly limited in conditions so long as the desired sheet bar dimensions are secured.

Finishing Rolling

The heated slab or the slab additionally roughing rolled in accordance with need is next finish rolled. The exit side temperature at the finishing rolling is controlled to 820 to 920° C. If the exit side temperature of the finishing rolling is more than 920° C., the austenite becomes coarser and the condition of the average pearlite block size of the final finished product (that is, 20.0 μm or less) is no longer satisfied. For this reason, the upper limit of the exit side temperature of the finishing temperature is 920° C., preferably 900° C., more preferably 880° C. From such a viewpoint, it is not necessary to provide a lower limit for the exit side temperature of the finishing rolling so long as the Ar3 point or more, but the lower the temperature, the more the deformation resistance of the steel sheet increases. A massive load is applied to the rolling machine and can become the case of equipment trouble. For this reason, the lower limit of the exit side temperature of the finishing rolling is 820° C.

Cooling

After the end of the finishing rolling, the steel sheet is cooled. The cooling is furthermore subdivided into primary cooling and secondary cooling.

Primary Cooling Down to Ae1 Point by Average Cooling Rate of 40 to 80° C./s In the primary cooling, the steel sheet is cooled from the above exit side temperature of the finishing rolling by an average cooling rate of 40 to 80° C./s down to the Ae1 point. If the average cooling rate down to the above temperature is less than 40° C./s, pro-eutectoid ferrite and/or pro-eutectoid cementite precipitates and the above target value of the pearlite fraction (90% or more) is liable to be unable to be achieved. The average cooling rate of the primary cooling may be 43° C./s or more or 45° C./s or more. On the other hand, if the average cooling rate becomes too high, the steel sheet can no longer be uniformly cooled and variations are liable to arise in the quality. Therefore, the average cooling rate of the primary cooling may be made 80° C./s or less. For example, it is 70° C./s or less. Note that, Ae1 (° C.) can be found using the following formula:

$$Ae1(°\,C.)=723-10.7\times[Mn]+29.1\times[Si]$$

where, in the formula, the symbols of elements in the brackets respectively show the contents of the elements by mass %.

Secondary Cooling from Ae1 Point Down to Coiling Temperature by Average Cooling Rate of Less than 20° C./s Next, in the secondary cooling, the steel sheet is cooled from the Ae1 point down to the coiling temperature (that is, the 540 to 700° C. temperature region) by an average cooling rate of less than 20° C./s. By making the cooling rate slower than the primary cooling in this way, it is possible to form pearlite structures more random in lamellar direction and possible to make the lamellar spacing finer to improve the hole expandability. On the other hand, if the average cooling rate down to that temperature region is high, the lamellar spacing ends up becoming uneven inside the steel sheet and the hole expandability is liable to deteriorate or pseudo pearlite is formed in a large amount and the target value of the pearlite fraction (90% or more) is liable to become unable to be achieved. Therefore, the average cooling rate of the above secondary cooling is less than 20° C./s and is preferably 15° C./s or less, more preferably 10° C./s or less, most preferably 10° C./s or less. The secondary cooling is preferably performed immediately after the end of the primary cooling so as to reliably suppress formation of ferrite.

Coiling

After the cooling, the steel sheet is coiled. The temperature of the steel sheet at the time of coiling is 540 to 700° C. By controlling the coiling temperature to 540 to 700° C., it is possible to make the structure suitably transform during coiling to make the average lamellar spacing of the pearlite finer and thereby making the hot rolled steel sheet higher in strength without detracting from the ductility and hole expandability. On the other hand, if the coiling temperature is less than 540° C., other structures of pseudo pearlite, bainite, etc., appear and it becomes difficult to secure a pearlite fraction of 90% or more. Therefore, the coiling temperature is 540° C. or more and may be 550° C. or more or 600° C. or more as well. Further, if the coiling temperature is more than 700° C., the average lamellar spacing of the pearlite becomes larger and sufficient strength and/or hole expandability can no longer be secured. Therefore, the coiling temperature may be made 700° C. or less, 680° C. or less, or 650° C. or less. The conditions after the coiling are not particularly limited.

Below, examples will be used to explain the present invention in more detail, but the present invention is not limited by these examples in any way.

EXAMPLES

In the following examples, hot rolled steel sheets according to an embodiment of the present invention were produced under various conditions and the mechanical properties of the obtained hot rolled steel sheets were investigated.

First, the continuous casting method was used to produce slabs having the chemical compositions shown in Table 1. Next, the heating, hot rolling, cooling, and coiling conditions shown in Table 2 were used to produce thickness 3 mm hot rolled steel sheets from these slabs. The secondary cooling in the cooling step was performed right after the end of the primary cooling. Note that, the balances aside from the constituents shown in Table 1 are comprised of Fe and impurities. Further, the chemical compositions obtained by analyzing samples taken from the produced hot rolled steel sheets were equal to the chemical compositions of the slabs shown in Table 1. In addition, in the hot rolled steel sheets of all of the examples, the ratios of the amount of dissolved C were 10% or less.

TABLE 1

| Steel | Chemical composition (mass %, balance: Fe and impurities) | | | | | | | | | | | | | | | | | Ael |
|---|---|---|---|---|---|---|---|---|---|---|---|---|---|---|---|---|---|---|
| type | C | Si | Mn | P | S | Al | N | Cr | Cu | Ni | Mo | Nb | V | Ti | B | Ca | REM | [° C.] |
| A | 0.71 | 0.20 | 0.96 | 0.010 | 0.0006 | 0.010 | 0.0030 | 0.69 | — | — | — | — | — | — | — | — | — | 719 |
| B | 0.76 | 0.27 | 1.86 | 0.070 | 0.0020 | 0.087 | 0.0089 | 1.94 | — | — | — | — | — | 0.90 | — | — | — | 711 |
| C | 0.64 | 0.16 | 1.23 | 0.092 | 0.0087 | 0.017 | 0.0016 | 1.58 | — | — | — | 0.08 | — | — | — | — | — | 714 |
| D | 0.54 | 0.34 | 0.64 | 0.019 | 0.0084 | 0.070 | 0.0084 | 0.92 | — | — | — | — | 0.90 | — | — | — | — | 726 |
| E | 0.94 | 0.45 | 1.01 | 0.011 | 0.0012 | 0.009 | 0.0054 | 0.55 | — | — | — | — | — | — | 0.0050 | 0.0035 | — | 725 |
| F | 0.70 | 0.21 | 0.97 | 0.009 | 0.0006 | 0.010 | 0.0030 | 2.03 | — | — | — | — | — | — | — | — | — | 719 |
| G | 0.45 | 0.20 | 1.38 | 0.010 | 0.0008 | 0.010 | 0.0031 | 0.70 | — | — | — | — | — | — | — | — | — | 714 |
| H | 0.70 | 0.20 | 0.70 | 0.010 | 0.0010 | 0.030 | 0.0030 | 0.10 | — | — | — | — | — | — | — | — | — | 721 |
| I | 0.44 | 1.11 | 0.43 | 0.010 | 0.0020 | 0.030 | 0.0031 | 0.00 | — | — | — | 0.02 | — | — | — | — | — | 751 |
| J | 0.60 | 1.11 | 0.29 | 0.010 | 0.0020 | 0.030 | 0.0030 | 0.00 | — | — | — | — | — | 0.02 | — | — | — | 752 |
| K | 1.05 | 0.11 | 1.05 | 0.018 | 0.0091 | 0.016 | 0.0090 | 1.21 | — | — | — | — | — | — | 0.0087 | 0.0043 | — | 715 |
| L | 0.72 | 0.19 | 2.06 | 0.088 | 0.0014 | 0.086 | 0.0086 | 1.50 | — | — | — | 0.03 | — | 0.17 | 0.0084 | 0.0041 | — | 706 |
| M | 0.69 | 0.03 | 1.30 | 0.009 | 0.0020 | 0.030 | 0.0031 | 0.80 | 0.80 | — | — | — | — | — | — | — | — | 710 |
| N | 0.70 | 0.06 | 1.31 | 0.011 | 0.0021 | 0.031 | 0.0032 | 0.81 | — | 0.79 | — | — | — | — | — | — | — | 711 |
| O | 0.70 | 0.02 | 0.70 | 0.013 | 0.0020 | 0.030 | 0.0031 | 0.80 | — | — | 0.10 | — | — | — | — | — | — | 716 |
| P | 0.71 | 0.03 | 0.70 | 0.010 | 0.0029 | 0.029 | 0.0028 | 0.79 | — | — | — | — | — | — | — | — | 0.0030 | 716 |
| Q | 0.52 | 0.07 | 0.71 | 0.010 | 0.0030 | 0.031 | 0.0027 | 0.60 | — | — | — | — | — | 0.19 | — | — | — | 717 |

Underlines show outside scope of present invention.

"—" in table show corresponding chemical constituent not intentionally added.

TABLE 2

| | | Heating | | Hot rolling Exit side | Cooling | | Coiling |
|---|---|---|---|---|---|---|---|
| Test no. | Steel type | Heating temperature [° C.] | Heating time [min] | temperature of finishing rolling [° C.] | Primary cooling Average cooling rate [° C./s] | Secondary cooling Average cooling rate [° C./s] | Coiling temperature [° C.] |
| 1 | A | 1200 | 60 | 850 | 43 | 7 | 620 |
| 2 | A | 1200 | 60 | 823 | 43 | 8 | 540 |
| 3 | A | 1200 | 60 | 852 | 43 | 8 | 710 |
| 4 | A | 1200 | 60 | 860 | 13 | 10 | 600 |
| 5 | A | 1200 | 60 | 910 | 48 | 43 | 560 |
| 6 | A | 1200 | 60 | 840 | 52 | 13 | 520 |
| 7 | A | 1200 | 60 | 929 | 43 | 8 | 620 |
| 8 | B | 1250 | 60 | 880 | 48 | 8 | 640 |
| 9 | C | 1250 | 60 | 878 | 43 | 9 | 680 |
| 10 | D | 1250 | 60 | 905 | 46 | 10 | 620 |
| 11 | E | 1250 | 60 | 861 | 43 | 9 | 680 |
| 12 | F | 1200 | 60 | 848 | 43 | 8 | 540 |
| 13 | G | 1200 | 60 | 846 | 43 | 8 | 540 |
| 14 | H | 1200 | 60 | 951 | 43 | 8 | 560 |
| 15 | I | 1200 | 60 | 902 | 26 | 16 | 400 |
| 16 | J | 1200 | 60 | 879 | 43 | 7 | 540 |
| 17 | K | 1200 | 60 | 875 | 46 | 8 | 620 |
| 18 | L | 1200 | 60 | 904 | 43 | 10 | 540 |
| 19 | M | 1250 | 60 | 880 | 44 | 8 | 620 |
| 20 | N | 1250 | 60 | 883 | 44 | 8 | 620 |
| 21 | O | 1250 | 60 | 881 | 46 | 8 | 640 |
| 22 | P | 1250 | 60 | 880 | 52 | 10 | 640 |
| 23 | Q | 1250 | 60 | 882 | 52 | 10 | 600 |
| 24 | Q | 1250 | 60 | 879 | 46 | 8 | 640 |
| 25 | Q | 1250 | 60 | 881 | 52 | 10 | 560 |

Underlines show outside scope of present invention.

A JIS No. 5 tensile test piece was taken from each of the thus obtained hot rolled steel sheets in a direction perpendicular to the rolling direction and subjected to a tensile test based on JIS Z2241 (2011) to measure the tensile strength (TS) and total elongation (El). Further, it was subjected to a hole expansion test based on JIS Z2256 (2010) to measure the hole expandability (λ). The stampability was evaluated by punching a 10 mm diameter hole with a punching clearance of 12.5%, visually examining the properties of the end face, judging the case where a crack of a size of 0.5 mm or more is observed at the end face as "failing (Poor)", and judging the case where it is not observed as "passing (Good)". The case where the TS is 980 MPa or more, El is 13% or more, X is 45% or more, and the stampability was evaluated as passing was evaluated as a hot rolled steel sheet which is high in strength and excellent in ductility, hole expandability, and stampability. The results are shown in following Table 3.

TABLE 3

| | | | Metal structure | | | | Mechanical properties | | | | |
|---|---|---|---|---|---|---|---|---|---|---|---|
| Test no. | Steel type | Thickness [mm] | Pearlite fraction [area %] | Remaining structure [area %] | Average lamellar spacing [μm] | Average pearlite block size [μm] | TS [MPa] | El [%] | λ [%] | Stampability | Remarks |
| 1 | A | 2.5 | 91 | Pseudo pearlite: 9 | 0.10 | 12.3 | 1112 | 15 | 48 | Good | Ex. |
| 2 | A | 2.5 | 96 | Pseudo pearlite: 4 | 0.10 | 15.4 | 1148 | 14 | 64 | Good | Ex. |
| 3 | A | 2.5 | 48 | Pseudo pearlite and pro-eutectoid ferrite: total 52 | 0.22 | 16.8 | 968 | 18 | 38 | Good | Comp. ex. |
| 4 | A | 2.5 | 43 | Pseudo pearlite and pro-eutectoid ferrite: total 57 | 0.11 | 18.2 | 1080 | 18 | 34 | Good | Comp. ex. |
| 5 | A | 2.5 | 76 | Pseudo pearlite: 24 | 0.09 | 19.5 | 1209 | 14 | 27 | Good | Comp. ex. |
| 6 | A | 2.5 | 60 | Pseudo pearlite: 40 | 0.07 | 10.1 | 1362 | 11 | 18 | Good | Comp. ex. |
| 7 | A | 2.5 | 94 | Pseudo pearlite: 6 | 0.13 | 28.4 | 1040 | 17 | 42 | Good | Comp. ex. |
| 8 | B | 2.5 | 95 | Pseudo pearlite: 5 | 0.06 | 12.6 | 1226 | 15 | 51 | Good | Ex. |
| 9 | C | 2.5 | 96 | Pseudo pearlite: 4 | 0.08 | 10.6 | 1098 | 18 | 58 | Good | Ex. |
| 10 | D | 2.5 | 95 | Pseudo pearlite: 5 | 0.12 | 14.3 | 986 | 18 | 62 | Good | Ex. |
| 11 | E | 2.5 | 95 | Pseudo pearlite: 5 | 0.11 | 16.4 | 1223 | 14 | 49 | Good | Ex. |
| 12 | F | 2.5 | 52 | Pseudo pearlite and bainite: total 48 | 0.07 | 9.3 | 1353 | 11 | 27 | Good | Comp. ex. |
| 13 | G | 2.5 | 80 | Pseudo pearlite and pro-eutectoid ferrite: total 20 | 0.25 | 18.6 | 886 | 19 | 39 | Good | Comp. ex. |
| 14 | H | 2.5 | 91 | Pseudo pearlite: 9 | 0.24 | 30.6 | 933 | 18 | 21 | Good | Comp. ex. |
| 15 | I | 2.5 | 76 | Residual austenite: 24 | 0.18 | 15.2 | 1184 | 19 | 34 | Poor | Comp. ex. |
| 16 | J | 2.5 | 94 | Residual austenite: 6 | 0.20 | 11.5 | 1043 | 20 | 53 | Poor | Comp. ex. |
| 17 | K | 2.5 | 86 | Pseudo pearlite and pro-eutectoid cementite: total 14 | 0.12 | 17.2 | 1324 | 11 | 40 | Good | Comp. ex. |
| 18 | L | 2.5 | 88 | Pseudo pearlite: 12 | 0.08 | 17.9 | 1280 | 13 | 42 | Good | Comp. ex. |
| 19 | M | 2.5 | 98 | Pseudo pearlite: 2 | 0.09 | 12.6 | 1214 | 14 | 51 | Good | Ex. |
| 20 | N | 2.5 | 97 | Pseudo pearlite: 3 | 0.10 | 13.8 | 1197 | 14 | 56 | Good | Ex. |
| 21 | O | 2.5 | 97 | Pseudo pearlite: 3 | 0.14 | 15.1 | 1076 | 16 | 60 | Good | Ex. |
| 22 | P | 2.5 | 96 | Pseudo pearlite: 4 | 0.14 | 14.8 | 1095 | 15 | 57 | Good | Ex. |
| 23 | Q | 2.5 | 93 | Pseudo pearlite: 6 Pro-eutectoid ferrite: 1 | 0.15 | 11.6 | 1147 | 15 | 56 | Good | Ex. |
| 24 | Q | 1.2 | 92 | Pseudo pearlite: 7 Pro-eutectoid ferrite: 1 | 0.17 | 13.6 | 1102 | 15 | 46 | Good | Ex. |
| 25 | Q | 5.8 | 91 | Pseudo pearlite: 8 Pro-eutectoid ferrite: 1 | 0.09 | 10.5 | 1281 | 16 | 78 | Good | Ex. |

Underlines show outside scope of present invention.

As will be clear from Table 3, in each of Examples 1, 2, 8 to 11, and 19 to 25, the tensile strength was 980 MPa or more and El was 13% or more, X was 45% or more, and the stampability was evaluated as passing, so it was possible to obtain hot rolled steel sheet which was high strength and which was excellent in ductility, hole expandability, and stampability.

As opposed to these, in Comparative Example 3, the coiling temperature was more than 700° C., so the average lamellar spacing of the pearlite coarsened to more than 0.20 μm. For this reason, a TS of 980 MPa or more and a X of 45% or more could not be reached. In Comparative Example 4, the average cooling rate of the primary cooling in the cooling step was less than 40° C./s, pro-eutectoid ferrite was formed in a large amount, and the pearlite fraction became less than 90%. For this reason, a X of 45% or more could not be reached. In Comparative Example 5, the average cooling rate of the secondary cooling was high, so the pseudo pearlite increased and the pearlite fraction became less than 90%. For this reason, a X of 45% or more could not be reached. In Comparative Example 6, the coiling temperature in the coiling step was lower than 540° C., so pseudo pearlite increased and the pearlite fraction became less than 90%. For this reason, an El of 13% or more and a X of 45% or more could not be reached. In Comparative Example 7, the exit side temperature of the finishing rolling in the hot rolling step was more than 920° C., so the pearlite blocks coarsened and the average pearlite block size became more than 20.0 μm. For this reason, a X of 45% or more could not be reached.

In Comparative Example 12, the content of Cr was high, so the pseudo pearlite increased, bainite entered, and the pearlite fraction became less than 90%. For this reason, an El of 13% or more and an X of 45% or more could not be reached. In Comparative Example 13, the content of C was low, so a TS of 980 MPa or more could not be reached. In Comparative Example 14, the content of Cr was low, so a TS of 980 MPa or more could not be reached. Furthermore, in Comparative Example 14, the exit side temperature of the finishing rolling in the hot rolling step was more than 920° C., so the average pearlite block size ended up becoming more than 20.0 μm and a X of 45% or more could not be reached. In Comparative Examples 15 and 16, the content of Si was excessive, so residual austenite entered the remaining structure and the stampability became failing. In Comparative Example 17, the content of C was high, so pro-eutectoid cementite entered the remaining structure and the pearlite fraction became less than 90%. For this reason, an El of 13% or more and a X of 45% or more could not be reached. In Comparative Example 18, the content of Mn was high, so an X of 45% or more could not be reached.

The invention claimed is:

1. A hot rolled steel sheet comprising a chemical composition comprising, by mass %, C: 0.50 to 1.00%,
Si: 0.01 to 0.50%,
Mn: 0.50 to 2.00%,
P: 0.100% or less,
S: 0.0100% or less,
Al: 0.100% or less,
N: 0.0100% or less,
Cr: 0.50 to 2.00%,
Cu: 0 to 1.00%,
Ni: 0 to 1.00%,
Mo: 0 to 0.50%,
Nb: 0 to 0.10%,
V: 0 to 1.00%,
Ti: 0 to 1.00%,
B: 0 to 0.0100%,
Ca: 0 to 0.0050%,
REM: 0 to 0.0050%, and
balance: Fe and impurities, and
a metal structure comprising, by area ratio,
pearlite: 90 to 100%,
pseudo pearlite: 0 to 10%, and
pro-eutectoid ferrite: 0 to 1%, wherein
the pearlite has an average lamellar spacing of 0.20 μm or less, and
the pearlite has an average pearlite block size of 20.0 μm or less,
wherein the hot rolled sheet has a hole expandability of 45% or more.

2. The hot rolled steel sheet according to claim 1, wherein the chemical composition comprises, by mass %, one or more of Cu: 0.01 to 1.00%,
Ni: 0.01 to 1.00%,
Mo: 0.01 to 0.50%,
Nb: 0.01 to 0.10%,
V: 0.01 to 1.00%,
Ti: 0.01 to 1.00%,
B: 0.0005 to 0.0100%,
Ca: 0.0005 to 0.0050%, and
REM: 0.0005 to 0.0050%.

3. The hot rolled steel sheet according to claim 1, wherein the hot rolled steel sheet has a tensile strength of 980 to 1281 MPa.

4. The hot rolled steel sheet according to claim 2, wherein the hot rolled steel sheet has a tensile strength of 980 to 1281 MPa.

5. A method for producing a hot rolled steel sheet comprising heating a slab having the chemical composition of claims 1 to 1100° C. or more,
hot rolling including finishing rolling the heated slab, wherein an exit side temperature of the finishing rolling is 820 to 920° C.,
primary cooling the obtained steel sheet down to an Ae1 point by an average cooling rate of 40 to 80° C./s, then secondary cooling the steel sheet from the Ae1 point down to a coiling temperature by an average cooling rate of less than 20° C./s, and
coiling the steel sheet at a coiling temperature of 540 to 700° C.

6. The hot rolled steel sheet according to claim 1, wherein the chemical composition comprises, by mass %, Mn: 1.01 to 2.00%.

7. The hot rolled steel sheet according to claim 1, wherein the chemical composition comprises, by mass %, Al: 0.0005 to 0.100%.

8. The hot rolled steel sheet according to claim 6, wherein the chemical composition comprises, by mass %, Al: 0.0005 to 0.100%.

9. The hot rolled steel sheet according to claim 1, wherein the chemical composition comprises, by mass %, Ni: 0.10 to 1.00%.

10. The hot rolled steel sheet according to claim 6, wherein the chemical composition comprises, by mass %, Ni: 0.10 to 1.00%.

11. The hot rolled steel sheet according to claim 7, wherein the chemical composition comprises, by mass %, Ni: 0.10 to 1.00%.

12. The hot rolled steel sheet according to claim 8, wherein the chemical composition comprises, by mass %, Ni: 0.10 to 1.00%.

13. The hot rolled steel sheet according to claim 1, wherein the chemical composition comprises, by mass %, C: 0.53 to 1.00%.

14. The hot rolled steel sheet according to claim 1, wherein the chemical composition comprises, by mass %, C: 0.55 to 1.00%.

15. The hot rolled steel sheet according to claim 1, wherein the chemical composition comprises, by mass %, C: 0.60 to 1.00%.

16. The hot rolled steel sheet according to claim 1, wherein the metal structure comprises, by area ratio, pseudo pearlite: 2 to 10%.

* * * * *